US009004384B2

(12) United States Patent
Schiff et al.

(10) Patent No.: US 9,004,384 B2
(45) Date of Patent: Apr. 14, 2015

(54) OSTEOBIOLOGIC MILLING MACHINE

(75) Inventors: Charles Schiff, Montgomery, TX (US); Rudy Duke, Brick, NJ (US); David Kaes, Tom River, NJ (US)

(73) Assignee: Warsaw Orthopedic, Inc., Warsaw, IN (US)

( * ) Notice: Subject to any disclaimer, the term of this patent is extended or adjusted under 35 U.S.C. 154(b) by 577 days.

(21) Appl. No.: 13/333,279

(22) Filed: Dec. 21, 2011

(65) Prior Publication Data

US 2012/0160945 A1 Jun. 28, 2012

Related U.S. Application Data

(60) Provisional application No. 61/426,104, filed on Dec. 22, 2010.

(51) Int. Cl.

| | |
|---|---|
| ***B02C 18/22*** | (2006.01) |
| ***B02C 19/00*** | (2006.01) |
| ***B02C 18/38*** | (2006.01) |

(52) U.S. Cl.

CPC ..... *B02C 19/0056* (2013.01); *B02C 18/2233* (2013.01); *B02C 18/2291* (2013.01); *B02C 18/38* (2013.01)

(58) Field of Classification Search

USPC ..... 241/280, 282, 286

See application file for complete search history.

(56) References Cited

U.S. PATENT DOCUMENTS

| | | | |
|---|---|---|---|
| 5,607,269 | A | 3/1997 | Dowd et al. |
| 5,769,853 | A | 6/1998 | Quetin |
| 6,318,651 | B1 | 11/2001 | Spiering |
| 7,588,202 | B2 | 9/2009 | Rasekhi |
| 2009/0118735 | A1 | 5/2009 | Burmeister, III et al. |

FOREIGN PATENT DOCUMENTS

| | | | |
|---|---|---|---|
| KR | 100837544 | B1 | 6/2008 |

OTHER PUBLICATIONS

PCT/US2011/066515 Written Opinion of the International Search Report, Aug. 12, 2013.

*Primary Examiner* — Mark Rosenbaum

(74) *Attorney, Agent, or Firm* — Sorell Lenna & Schmidt LLP

(57) ABSTRACT

The present disclosure, in one aspect, relates to a milling apparatus having a cutter housing and feed chute, a rotary cutter, at least partially housed within the cutter housing and in communication with the feed chute, and a feed ram removably positioned within the feed chute for maintaining a workpiece against the rotary cutter. The feed chute and feed ram may be selectively positionable at one of several angular positions with respect to the rotary cutter. In this manner, the force applied by the feed ram on the workpiece is a function of the weight of the feed ram and the angular position of the feed ram with respect to the rotary cutter.

19 Claims, 9 Drawing Sheets

OSTEOBIOLOGIC MILLING MACHINE

CROSS-REFERENCE TO RELATED APPLICATION

This application claims the benefit of U.S. Provisional Patent Application No. 61/426,104 filed Dec. 22, 2010, and is hereby incorporated in its entirety by reference.

FIELD OF THE INVENTION

The present disclosure relates to osteobiologic milling machines and methods of using the same. More particularly, the present disclosure relates to bone milling machines and methods of using the same resulting in up to about one-hundred percent (about 100%) workpiece utilization. That is, the osteobiologic milling machines and methods of the present disclosure use the majority of the bone and up to one-hundred percent can be used. The present disclosure further relates to osteobiologic milling machines with novel feed and indexing mechanisms.

BACKGROUND OF THE INVENTION

In traditional milling practice, as shown in FIG. 1, a workpiece 102 is held in a vice or other holding device 104. The portion 102*a* of the workpiece that is outside of the clamp or holding portion of the vice or other holding device 104 is milled using consecutive indexed passes of a cutter 106 of a suitable milling machine 108. Particularly, consecutive indexed passes of, for example, back-and-forth feed motion of a rotary cutter 106 are used to mill the portion 102*a* of the workpiece. Another traditional bone milling apparatus is disclosed in U.S. Pat. No. 5,607,269, which is hereby incorporated by reference herein in its entirety. In a traditional bone milling apparatus, such as the foregoing, only the portion 102*a* of the workpiece that is outside the vice or other holding device 104 is able to be milled. The portion 102*b* of the workpiece that is held within the holding device 104 cannot be milled, and thus, becomes scrap or waste material.

Where the material of workpiece is valuable, such as but not limited to human bone or tissue, the inability to mill the remaining portion held within the holding device can become a substantial or important issue. In some cases, at least up to twenty-five percent (25%) of the workpiece may be held within the holding device and becomes scrap material. Where the workpiece is human bone, for example, this amount of scrap material can be unacceptable, both financially and morally.

Thus, there exists a need in the art for osteobiologic milling machines and methods of using the same resulting in up to about one-hundred percent (100%) workpiece utilization. There is also need in the art for osteobiologic milling machines where all bone contacting components can be easily cleaned or autoclaved. There is a further need in the art for osteobiologic milling machines with novel feed and indexing mechanisms.

BRIEF SUMMARY OF THE INVENTION

The present disclosure, in one embodiment, relates to a milling apparatus having a cutter housing and feed chute, a rotary cutter, at least partially housed within the cutter housing and in communication with the feed chute, and a feed ram removably positioned within the feed chute for maintaining a workpiece against the rotary cutter. The feed chute and feed ram may be selectively positionable at one of several angular positions with respect to the rotary cutter. In this manner, the force applied by the feed ram on the workpiece is a function of the weight of the feed ram and the angular position of the feed ram with respect to the rotary cutter.

The present disclosure, in another embodiment, relates to a milling apparatus having a cutter housing and feed chute, a rotary cutter, at least partially housed within the cutter housing and in communication with the feed chute, a feed ram removably positioned within the feed chute for maintaining a workpiece against the rotary cutter, and a tightening device coupled with the feed ram. The tightening device may be used to selectively and controllably provide a force to the feed ram in the direction of the rotary cutter.

The present disclosure, in yet a further embodiment, relates to a method of milling fibers, including inserting a workpiece into a milling apparatus. The milling apparatus includes a cutter housing and feed chute, a rotary cutter, at least partially housed within the cutter housing and in communication with the feed chute, and a feed ram removably positioned within the feed chute for maintaining the workpiece against the rotary cutter. The method further includes selectively positioning the feed chute and feed ram at one of several angular positions with respect to the rotary cutter. In this manner, the force applied by the feed ram on the workpiece is a function of the weight of the feed ram and the angular position of the feed ram with respect to the rotary cutter.

While multiple embodiments are disclosed, still other embodiments of the present disclosure will become apparent to those skilled in the art from the following detailed description, which shows and describes illustrative embodiments of the disclosure. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the embodiments will be better understood from the following description taken in conjunction with the accompanying Figures, in which:

DETAILED DESCRIPTION

For the purposes of this specification and appended claims, unless otherwise indicated, all numbers expressing quantities of ingredients, percentages or proportions of materials, reaction conditions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein. For example, a range of "1 to 10" includes any and all subranges between (and including) the minimum value of 1 and the maximum value of 10, that is, any and all subranges having a minimum value of equal to or greater than 1 and a maximum value of equal to or less than 10, e.g., 5.5 to 10.

It is noted that, as used in this specification and the appended claims, the singular forms "a," "an," and "the," include plural referents unless expressly and unequivocally limited to one referent.

The present disclosure relates to novel and advantageous osteobiologic milling machines and methods of using the same. Particularly, the present disclosure relates to novel and advantageous bone milling machines and methods of using the same resulting in up to about one-hundred percent (100%) workpiece utilization. The present disclosure further relates to osteobiologic milling machines with novel feed and indexing mechanisms.

Figure 1:
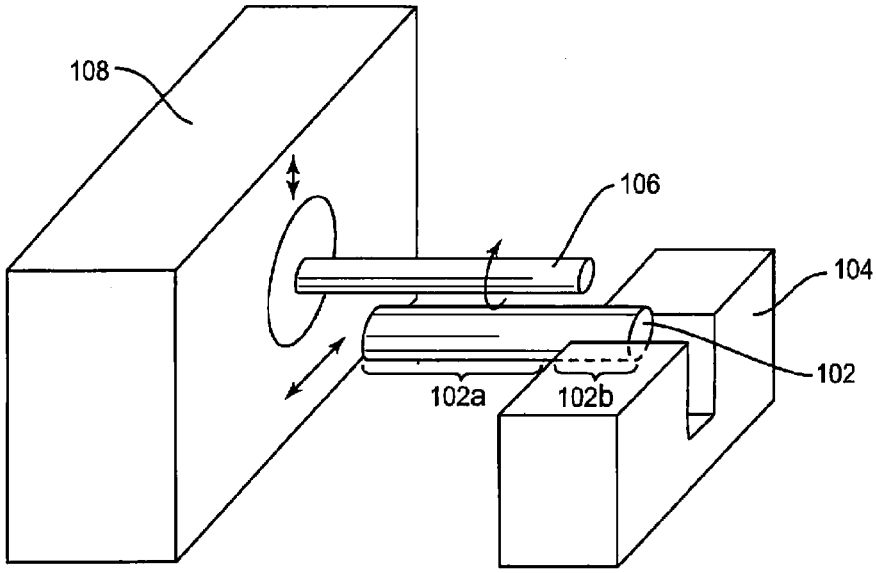
FIG. 1 is a perspective view of a traditional bone milling apparatus.
Figure 2:
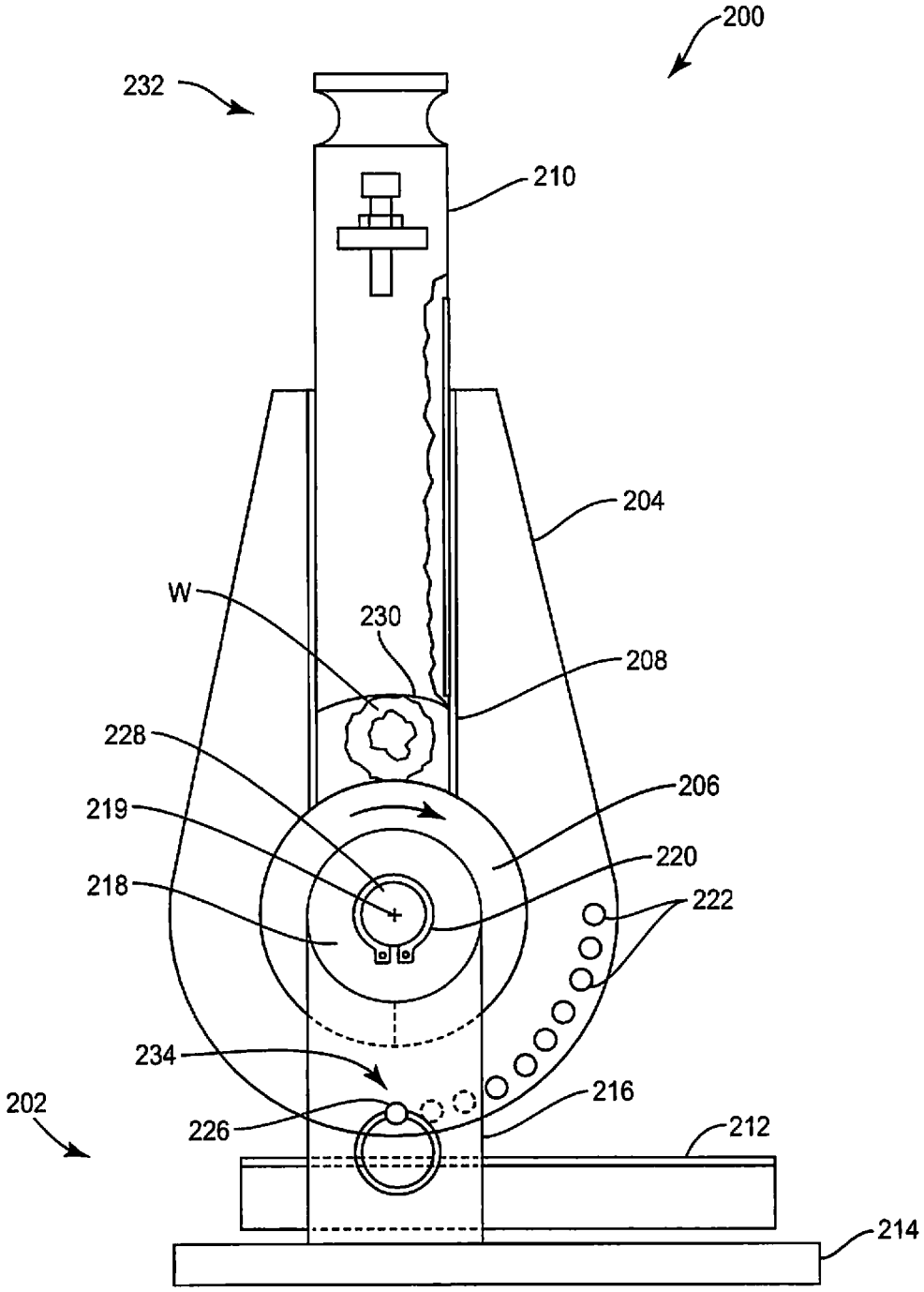
FIG. 2 is a side, cross-sectional view of an osteobiologic milling machine in accordance with one embodiment of the present disclosure.
Figure 3:
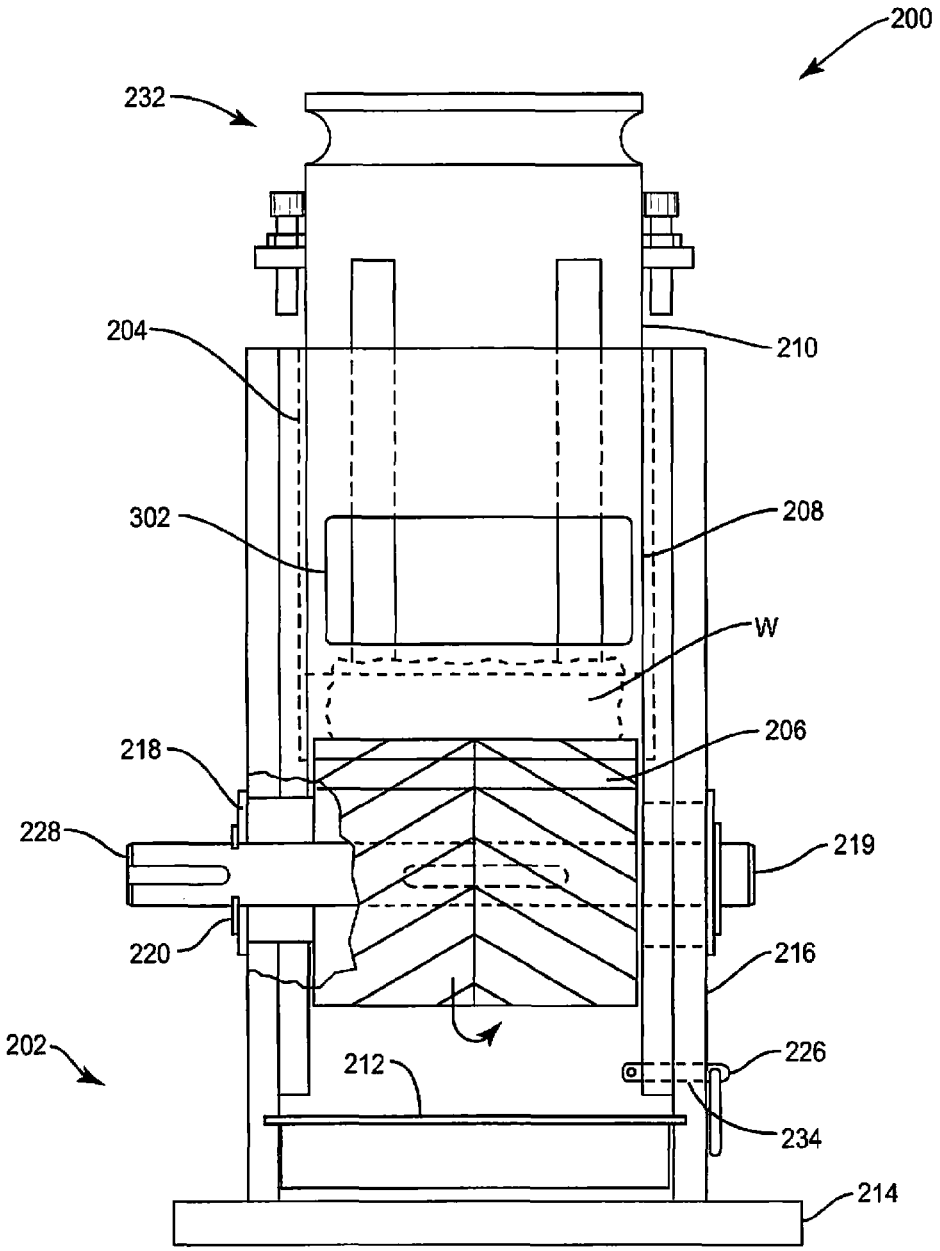
FIG. 3 is a front and partial cross-section view of the osteobiologic milling machine of FIG. 2.
Figure 4:
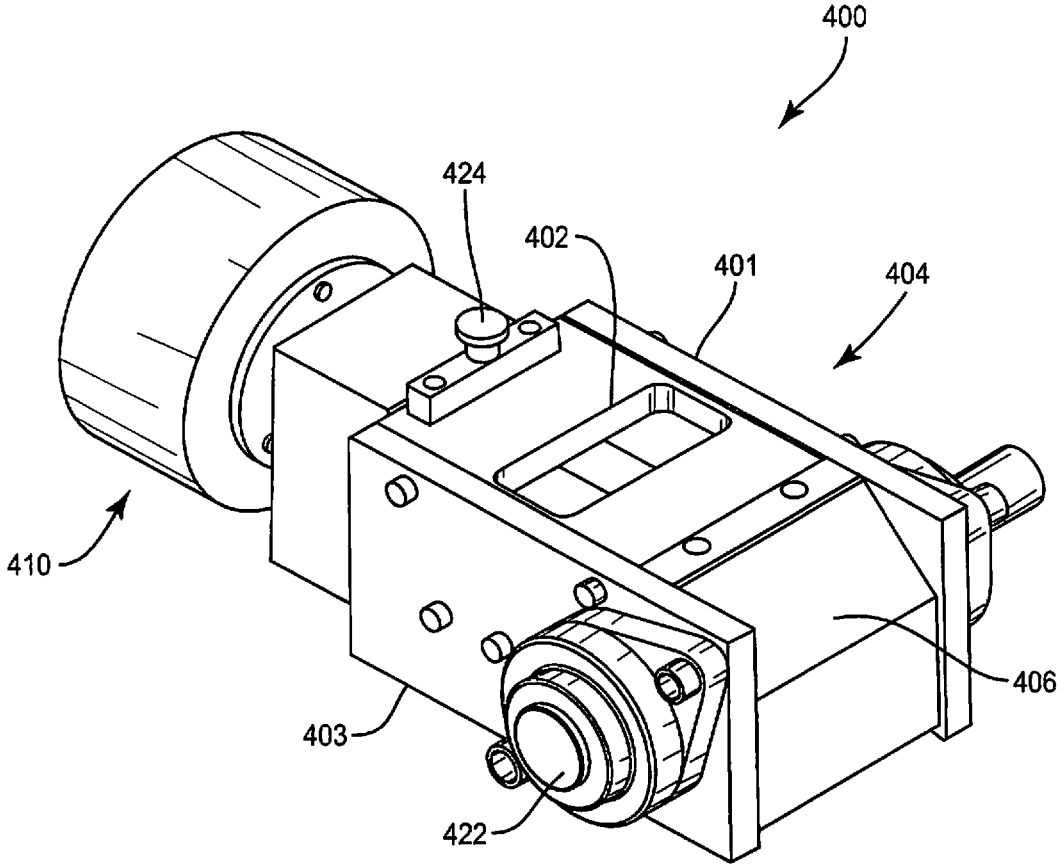
FIG. 4 is a perspective view of an osteobiologic milling machine in accordance with another embodiment of the present disclosure.
Figure 5:
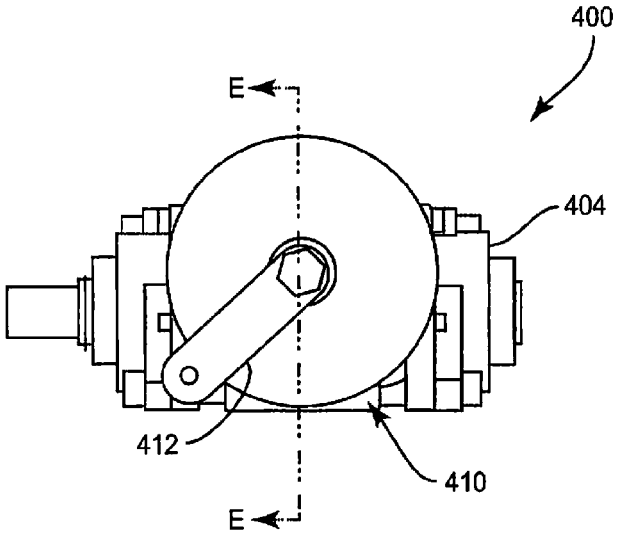
FIG. 5 is an end view of the osteobiologic milling machine of FIG. 4.
Figure 6:
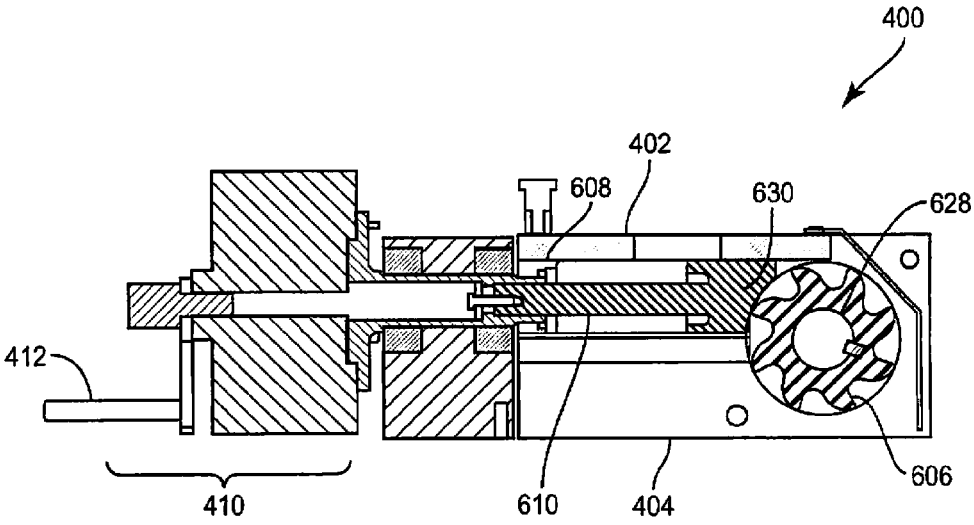
FIG. 6 is a side, cross-sectional view of the osteobiologic milling machine of FIG. 5, taken along line E.

As shown in FIGS. 2 and 3, an osteobiologic milling machine 200 according to an embodiment of the present disclosure may include a base 202, a cutter housing 204, a rotary cuter 206, a feed chute 208 and feed ram 210, and a fiber collection unit 212.

The base 202 may be any suitable base configured for supporting and/or securing the cutter housing 204 in a suitable location. In one embodiment, the base 202 may include a base element 214 and a cutter housing support structure 216. The base element 214 may help balance and/or support the milling machine 200. The base element 214 may be integral with or connectable with support structure 216. The base element 214 may be made from any suitable material, such as but not limited to metal, metal alloy, plastic, wood, or any other suitable material or combinations thereof. In some embodiments, the base element 214 may be generally flat and have any suitable shape configured for assisting in balancing and/or supporting the milling machine 200. In alternative embodiments, base 202 may not include base element 214, and housing support structure 216 may simply be supported by any suitable underlying surface, such as but not limited to, a table top or workshop surface. In further embodiments, the housing support structure 216 may be directly connected, temporarily or permanently, to any suitable support surface, such that the housing support structure 216 is generally immobilized during operation.

In one embodiment, the housing support structure 216 may include a support bearing 218. The support bearing 218 may be configured to generally support the cutter housing 204, such that the cutter housing is rotatable along the central axis 219 of the bearing and in relation to the housing support structure 216. As will be described in more detail below, in one embodiment, the cutter housing 204 may be selectively rotatable between several orientations with respect to the housing support structure 216.

Similar to the base element 214, the housing support structure 216 may be made from any suitable material, such as but not limited to metal, metal alloy, plastic, wood, or any other suitable material or combinations thereof. In one embodiment, the base element 214 and the housing support structure 216 may be made of the same material or combination of materials.

In alternative embodiments, milling device 200 may not include a base 202 nor housing support structure 216, and instead, the cutter housing 204 may simply be supported by support bearing 218 supported by any suitable structure, such as but not limited to, a wall or other substantially vertical workshop surface, for example. In further embodiments, the support bearing 218 may be directly connected, temporarily or permanently, to any suitable structure.

The cutter housing 204 may generally, but not necessarily entirely, house the rotary cutter 206. The cutter housing 204 may be removably coupled to the base 202, or more particularly to housing support structure 216. In one embodiment, the cutter housing 204 may be removably coupled with the support bearing 218, and may be held in a coupled position using a retention device 220, such as but not limited to a snap ring, locking pin, or any other suitable retention device or combination of retention devices. The cutter housing 204 may be made from any suitable material, such as but not limited to metal, metal alloy, plastic, wood, or any other suitable material or combinations thereof, and in some embodiments, may be made of a material or combination of materials that are cleanable and/or autoclavable. Thus, cutter-housing 204 may be decoupled from the base 202, such that it may be separately cleaned and/or autoclaved.

As will be described in more detail below, the cutter housing 204 may include a plurality of selectable orientation slots 222, which may allow the cutter housing 204 to be selectively rotatable between several orientations with respect to the housing support structure 216. In one embodiment, the orientation slots 222 may be holes that extend at least partially into the walls of the cutter housing 204. In a further embodiment, the orientation slots 222 may be configured to receive a retention device 226, such as but not limited to, locking pin or other suitable retention device or combination of retention devices.

The rotary cutter 206 may be coupled with or integrally attached to an axle 228, such that the rotary cutter rotates with, and is rotatable along the axis of, the axle at a desired cutter rotational speed. In one embodiment, the axle 228 may be manually rotated, for example, by hand. A crank, or other mechanism, may be provided such that the axle 228 may be generally easily manually rotated. In other embodiments, the axle 228, and thus the rotary cutter 206, may be connected to a drive motor, such as a variable speed drive motor. The drive motor may be operated manually, electrically, or by a computer. In one embodiment, the drive motor may be isolated from the milling machine 200, such as in an isolation chamber or an adjacent room, etc., so that any contaminants, such as dust, grease, etc., created by the drive motor can be kept away from the milling machine. In some embodiments, the milling machine 200 may be used in a clean room environment.

The rotary cutter 206 may be any suitable length and diameter. In one embodiment, the rotary cutter 206 may be a length that is equal to or greater than the length of the workpieces for which the milling device 200 is designed to receive for milling. For example, in one embodiment, the rotary cutter 206 may have a length, along its axis, of between three and one-half (3½) to four (4) inches. However, any suitable length rotary cutter 206 may be used. The rotary cutter 206 may likewise have any suitable diameter. In one embodiment, the rotary cutter 206 may have a diameter of about three (3) inches. However, any diameter less than or greater than three (3) inches is considered within the scope of the various embodiments of the present disclosure.

The rotary cutter 206 may also have any suitable number of teeth or bladed edges. In some embodiments, the rotary cutter 206 may have between two (2) and ten (10) teeth or bladed edges. However, a single tooth or bladed edge as well as greater than ten (10) teeth or bladed edges are considered within the scope of the various embodiments of the present disclosure. In one example embodiment, the rotary cutter 206 may include eight (8) teeth or bladed edges.

The teeth or bladed edges of the rotary cutter 206 may be configured in any suitable fashion along the rotary cutter, and in some embodiments, may depend on the desired specifications of the fibers resulting from the milling process. In one embodiment, the teeth or bladed edges may each be configured in a helical pattern around the rotary cutter 206. The helical pattern of the teeth or bladed edges may traverse the length of the rotary cutter 206 at any suitable helix angle. In some embodiments, the helical pattern of the teeth or bladed edges may traverse the length of the rotary cutter 206 at a helix angle up to about thirty degrees (30°). However, helix angles above thirty degrees (30°) are considered within the scope of the various embodiments of the present disclosure. The helix angle of the teeth or bladed edges may be one factor in determining the thickness of the fibers for a given cutter rotational speed.

The rotary cutter 206 may be made from any suitable material, such as but not limited to metal, metal alloy, plastic, or any other suitable material or combinations thereof, and in some embodiments, may be made of a material or combination of materials that are cleanable and/or autoclavable. Thus, rotary cutter 206 may be decoupled from the cutter housing 204, such that it may be separately cleaned and/or autoclaved.

The cutter housing 204 may include a feed chute 208. The feed chute 208 may generally be an opening, bore, or chute within the cutter housing 204 providing access for a workpiece W to be presented to the rotary cutter 206. In one embodiment, the feed chute 208 may be configured to receive a workpiece W of any suitable size and shape. In further embodiments, the feed chute 208 may be configured to receive a workpiece W having a length and present the workpiece to the rotary cutter 206, such that the length of the workpiece is substantially parallel to the axis of the rotary cutter. Accordingly, in some embodiments, the rotary cutter 206 may be designed so as to cut fibers from the workpiece along, or parallel to, the longitudinal axis of the workpiece W. Where the workpiece W is bone, this results in the milling, and resulting fibers, being prepared along the axis of the bone, so that the resulting yield is fibers of suitable length, with properties and characteristics of the naturally occurring fibers in the bone.

In one embodiment, the feed chute 208 may be configured to work with workpieces having a length of up to about three and one-half (3½) inches. However, it is contemplated that the feed chute 208 may be configured to work with workpieces having a length greater than three and one-half (3½) inches. In one embodiment, the workpiece W may be bone, including but not limited to, human donor bone. However, a workpiece may be any suitable material or combination of materials that are desired to be milled.

The feed ram 210 may be removably inserted into the feed chute 208 and may be axially moveable along the feed chute. The feed ram 210 may have a workpiece engaging end or surface 230 for engaging the workpiece W and holding the workpiece against the rotary cutter 206. The engaging end or surface 230 may include one or more engaging features that assist in maintaining the workpiece W against the rotary cutter 206, and in some embodiments, assist in preventing the workpiece from rotating, for example about its longitudinal axis, while it is in contact with the rotary cutter. The engaging features may include any suitable types of features, such as but not limited to, serrations, spikes, nodules, one or more textured surfaces, or the like, or any combinations thereof. The engaging features may be integral with the feed ram 210 or may be permanently or removably attached to the feed ram. The engaging features may be made of a similar or different material than the feed ram 210.

The feed ram 210 may also include a gripping portion 232, or handle portion, at or near the opposite end from the workpiece-engaging end 230. The gripping portion 232 may be used to decouple or remove the feed ram 210 from the feed chute 208, or position the feed ram to any desired position within the feed chute, such as for insertion of another workpiece W.

In some embodiments, the feed ram 210, workpiece engaging surface 230, or portions of the feed ram or workpiece engaging surface may be dimensioned such that the feed ram, workpiece engaging surface, or those portions thereof generally form a seal with the feed chute 208. However, in alternative embodiments, a seal need not be formed, and the feed ram 210 may be configured to fit the feed chute 208 loosely, snuggly, or anywhere therebetween.

In some embodiments, the cutter housing 204 may have a feed chute access opening 302. The access opening 302 may provide access to the feed chute 208 from the exterior of the cutter housing 204, such that a workpiece W may be placed within the feed chute. In one embodiment, the access opening 302 may provide access to the feed chute 208 without removing the feed ram 210 entirely from the feed chute. In further embodiments, the access opening 302 may not be accessible while the feed ram 210 is in a working position already holding a workpiece W against the rotary cutter 206, or in an otherwise full insertion state. In some embodiments, the feed ram 210 itself may block access from the access opening 302 when in a working position or an otherwise full insertion state. However, the cutter housing 204, feed chute 208, and/or feed ram 210 may be designed for any desired configuration of when access to the feed chute through the access opening 302 is permitted.

In some embodiments, based on the materials used to manufacture the feed ram 210, the feed ram may already have a desired amount of weight. However, in other embodiments, the feed ram 210 may be specifically designed to have a desired weight or may include additional weight to give the feed ram 210 a desired weight. In some embodiments, the weight may be integral with the feed ram 210, while in other embodiments, the weight may be permanently or removably attached to the feed ram. In still further embodiments, the added weight of the feed ram 210 may be interchangeable, such that the weight of the feed ram may be selectively changed using a variety of interchangeable weights. Due to the force of gravity, the weight of the feed ram 210 may be one factor assisting in maintaining the workpiece W against the rotary cutter 206, and in some embodiments, assist in preventing the workpiece from rotating while it is in contact with the rotary cutter.

The feed ram 210 may be made from any suitable material, such as but not limited to metal, metal alloy, plastic, wood, or any other suitable material or combinations thereof, and in some embodiments, may be made of a material or combination of materials that are cleanable and/or autoclavable. Thus, feed ram 210 may be decoupled from the cutter housing 204 and feed chute 208, such that it may be separately cleaned and/or autoclaved.

As discussed above, the cutter housing 204 may be selectively rotatable between several orientations with respect to the housing support structure 216. A rotatable nature of the cutter housing 204 can permit several different angular feed orientations of the feed chute 208 with respect to the rotary cutter 206.

In one embodiment, the plurality of selectable orientation slots 222 of the cutter housing 204 and the retention device 226 may work in conjunction with a locking slot 234 of the housing support structure 216. That is, the retention device 226 may be positioned in such a manner as to extend into one of the orientation slots 222 of the cutter housing 204 and a locking slot 234 of the housing support structure 216, thereby substantially retaining the cutter housing at a selected angular orientation. As discussed above, a retention device 226 may be but is not limited to, a locking pin or other suitable retention device or combination of retention devices. In further embodiments, the orientation slots 222 and locking slot 234 may be holes that extend through the walls of the cutter housing 204 and housing support structure 216, respectively. Accordingly, in one embodiment, the retention device 226 may be inserted through a locking slot 234 of the housing support structure 216 and extend into or through one of the orientation slots 222 of the cutter housing 204. In alternative embodiments, the housing support structure 216 may include multiple selectable orientation slots while the cutter housing 204 may include a locking slot 234. In still further embodiments, both the housing support structure 216 and the cutter housing 204 may have multiple selectable orientation slots, which in combination permit the cutter housing to be selectively rotatable between several orientations with respect to the housing support structure.

In one embodiment, the cutter housing 204 may be selectively angularly oriented between a substantially horizontal or zero degree (0°) position, whereby the feed chute 208 is substantially at a horizontal or zero degree (0°) orientation with respect to the rotary cutter 206, and a vertical or ninety degree (90°) position, whereby the feed chute is substantially at a vertical or ninety degree (90°) orientation with respect to the rotary cutter. However, it is understood that the range of angular rotation of the cutter housing 204 may include any other suitable range greater than or less than a ninety-degree (90°) range and is not limited to a ninety degree (90°) range. Whatever the rotation range, there may be any suitable number of orientation slots 222 to permit any suitable number of selectable angular positions within the rotation range. In some embodiments, the number of orientation slots 222, and thus selectable angular positions, may be limited by the size of the orientation slots and the amount of physical space designated for the orientation slots.

As mentioned above, a rotatable nature of the cutter housing 204 can permit several different angular feed orientations of the feed chute 208 with respect to the rotary cutter. Rotation of the cutter housing 204 can thus permit varying amounts of force to be applied to the workpiece W by the feed ram 210 simply due to the forces of gravity acting on the feed ram at each angular position. For example, at a substantially horizontal or zero degree (0°) orientation, the forces of gravity acting on the feed ram 210 may be such that the feed ram applies substantially no force against the workpiece W. Similarly, at a substantially vertical or ninety degree (90°) orientation, the forces of gravity acting on the feed ram 210 may be such that the feed ram applies substantially the full force of its weight against the workpiece W. As will be understood, any amount of force between substantially no force and substantially full force may be provided for between a horizontal or zero degree (0°) orientation and a vertical or ninety degree (90°) orientation.

In other embodiments, in addition to or as an alternative to providing selectable angular feed orientations, the feed ram 210 may be but is not limited to a screw drive or a pneumatic or hydraulic ram. Thus, the force of the feed ram 210 may also be selectively provided by altering the parameters of the screw drive or pneumatic or hydraulic ram.

The fiber collection unit 212 may be any suitable structure for the collection of milled fibers from workpiece W as a result of contact with the rotary cutter 206. In some embodiments, the fiber collection unit 212 may be a plate, tray, basket, bucket, or any other suitable structure or combination of structures that is suitable for the collection of fibers. In one embodiment, there may be multiple fiber collection units 212. Fiber collection unit 212 may be removably positioned generally beneath or proximate to the rotary cutter 206, such that the milled fibers from workpiece W as a result of contact with the rotary cutter may fall generally onto or into the fiber collection unit. The fiber collection unit 212 may be generally easily removed from the milling device 200 such that the fibers collected therein may be removed for use as is or for further processing. In some embodiments, the fiber collection unit 212 may be temporarily coupled with the milling device 200 such that the fiber collection unit 212 does not move while the milling device 200 is in use. Such temporary coupling may be provided by any suitable coupling means, such as but not limited to, snap fit, friction fit, screw fit, bayonet fit, clamping, or any other suitable coupling mechanism or combination of coupling mechanisms.

The fiber collection unit 212 may be made from any suitable material, such as but not limited to metal, metal alloy, plastic, wood, or any other suitable material or combinations thereof, and in some embodiments, may be made of a material or combination of materials that are cleanable and/or autoclavable. Thus, fiber collection unit 212 may be decoupled from the milling device 200, such that it may be separately cleaned and/or autoclaved.

As will be appreciated, in one embodiment, each of the bone contacting components, such as but not limited to, the cutter housing 204, rotary cuter 206, feed ram 210, and/or fiber collection unit 212, may each be separated from one another, if desired, and cleaned. In a further embodiment, each of the bone contacting components may be, together or separately, cleaned through autoclaving.

An osteobiologic milling machine 400, in accordance with another embodiment of the present disclosure, is shown in FIGS. 4-10. Similar to the foregoing embodiments, milling machine 400 may include a cutter housing 404 comprising of a backing plate 401, a front cover 403, a back sheet 406 and a front sheet 408. Milling device 400 may also include a rotary cutter 606, a feed chute 608 and feed ram 610. Front sheet 408 connects to front cover 403 via grooves, screws and/or bolts. Front cover 403 may have a handle (not shown). Hand screws 418 may be employed to secure front cover 403. Back sheet 406 connects to front sheet 408 via grooves, screws and/or bolts. Milling machine 400 may also include a locking handle 424 attached to housing 404.

Milling device 400 may also include a fiber collection unit similar to that described above. The milling machine 400 may be positioned at any suitable location and may be simply supported by any suitable surface, such as but not limited to, a table top, wall, or other workshop surface, for example. In further embodiments, the milling machine 400 may be directly connected, temporarily or permanently, to any suitable support surface, such that the milling machine is generally immobilized during operation.

Like cutter housing 204, the cutter housing 404 may generally, but not necessarily entirely, house the rotary cutter 606. The cutter housing 404 may be made from any suitable material, such as but not limited to metal, metal alloy, plastic, wood, or any other suitable material or combinations thereof, and in some embodiments, may be made of a material or combination of materials that are cleanable and/or autoclavable.

In some embodiments, a backing plate hole 414, located on backing plate 401 may be used to create a passageway to facilitate rotary cutter 606 connection with a selected mode of rotation. Gears and drive belts (not shown) can be contained within a gear casing (not shown) and positioned on shafts of the machine which are rotated by a crank or a motor in order to rotate the rotary cutter 606 so as to produce fibers that are then deposited out of the milling machine 400. For example, the axle communicates with the crank so as to rotate the blade to produce the fibers. In some embodiments, a torque tube may be located inside housing 404 (not shown) and a torque tube cap 422 may be used to transfer torque from a motor shaft to a drive gear.

In additional embodiments, like cutter housing 204, the cutter housing 404 may be coupled to a support bearing and may be selectively rotatable between several angular orientations. The cutter housing 404 may be held at a selected angular orientation using a retention device, as described above. A rotatable nature of the cutter housing 404 can permit several different angular feed orientations of the feed chute 608 with respect to the rotary cutter 606.

The rotary cutter 606 may be similar to the rotary cutter 206 discussed above. That is, the rotary cutter 606 may be coupled with or integrally attached to an axle 628, such that the rotary cutter 606 rotates with, and is rotatable along the axis of, the axle at a desired cutter rotational speed. In one embodiment, the axle 628 may be manually rotated, for example, by hand. A crank, or other mechanism, may be provided such that the axle 628 may be generally easily manually rotated. In other embodiments, the axle 628, and thus the rotary cutter 606, may be connected to a drive motor, such as a variable speed drive motor. The drive motor may be operated manually or may be computer-controlled. In one embodiment, the drive motor may be isolated from the milling machine 400, such as in an isolation chamber or an adjacent room, etc., so that any contaminants, such as dust, grease, etc., created by the drive motor can be kept away from the milling machine. In some embodiments, the milling machine may be used in a clean room environment.

As previously described, a rotary cutter 606 may be any suitable length and diameter and may have any suitable number of teeth or bladed edges. The teeth or bladed edges of the rotary cutter 606 may be configured in any suitable fashion along the rotary cutter, and in some embodiments, may depend on the desired specifications of the fibers resulting from the milling process. In one embodiment, the teeth or bladed edges may each be configured in a helical pattern around the rotary cutter 606 and may traverse the length of the rotary cutter at any suitable helix angle. The helix angle of the teeth or bladed edges may be one factor in determining the thickness of the fibers for a given cutter rotational speed.

Figure 7:
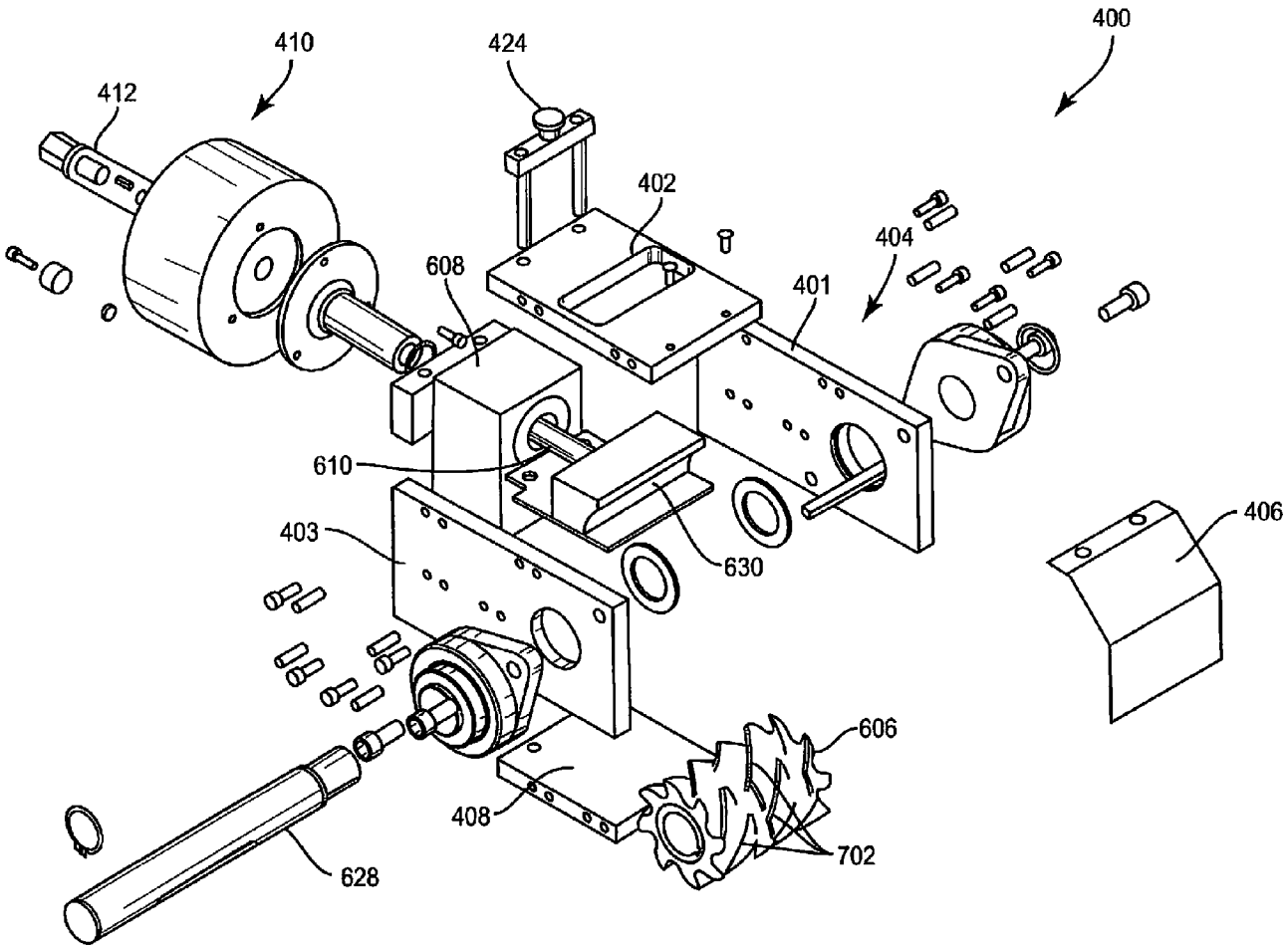
FIG. 7 is an exploded view of the osteobiologic milling machine of FIG. 4.

In further embodiments, as shown particularly in FIG. 7, a rotary cutter 606 may be designed to control the length of fiber that is milled from the workpiece W. For example, rotary cutter 606 may be configured to produce elongated particles. In one embodiment, the rotary cutter 606 may have breaks 702 or spaces in the teeth or bladed edges. The breaks 702 may provide a means for designating the length of time a tooth or bladed edge presses against the workpiece W, thereby milling a fiber from the workpiece. The distance between breaks 702 can be designed to control the desired length of fiber milled from the workpiece. While shown particularly in FIG. 7 and with respect to the embodiments of FIGS. 4-9, it is understood that a rotary cutter having breaks in the teeth or bladed edges may be used with any embodiment of a milling device disclosed herein, such as the embodiments disclosed in FIGS. 2 and 3. Other structures than breaks in the teeth or bladed edges also may be used to the length of the bone fibers or other milled pieces.

As with rotary cutter 206, the rotary cutter 606 may be made from any suitable material, such as but not limited to metal, metal alloy, plastic, or any other suitable material or combinations thereof, and in some embodiments, may be made of a material or combination of materials that are cleanable and/or autoclavable. Thus, rotary cutter 606 may be decoupled from the cutter housing 404, such that it may be separately cleaned and/or autoclaved.

The feed chute 608 may be similar to the feed chute 208 discussed above. That is, the feed chute 608 may generally be an opening, bore, or chute within the cutter housing 404 providing access for a workpiece W to be presented to the rotary cutter 606. In one embodiment, the feed chute 608 may be configured to receive a workpiece W of any suitable size and shape. In further embodiments, the feed chute 608 may be configured to receive a workpiece W having a length and present the workpiece to the rotary cutter 606, such that the length of the workpiece is substantially parallel to the axis of the rotary cutter. In one embodiment, the feed chute 608 may be configured to work with workpieces having a length of up to about three and one-half (3½) inches. However, it is contemplated that the feed chute 608 may be configured to work with workpieces having a length greater than three and one-half (3½) inches. In one embodiment, the workpiece W may be bone, including but not limited to, human donor bone. The workpiece W also can be a combination of bone and connective and other tissue, soft tissue, or any other material that is suitably processed by the invention herein. Generally, a workpiece may be any suitable material or combination of materials that are desired to be milled.

The feed ram 610 may be removably inserted into the feed chute 608 and may be axially moveable along the feed chute. The feed ram 610 may have a workpiece engaging end or surface 630 for engaging the workpiece W and holding the workpiece against the rotary cutter 606. Like feed ram 210, the engaging end or surface 630 may include one or more engaging features that assist in maintaining the workpiece W against the rotary cutter 606, and in some embodiments, assist in preventing the workpiece from rotating while it is in contact with the rotary cutter. As discussed above, the engaging features may include any suitable types of features, such as but not limited to, serrations, spikes, nodules, one or more textured surfaces, or the like, or any combinations thereof. The engaging features may be integral with the feed ram 610 or may be permanently or removably attached to the feed ram. The engaging features may be made of a similar or different material than the feed ram 610.

In some embodiments, the feed ram 610, workpiece engaging surface 630, or portions of the feed ram or workpiece engaging surface may be dimensioned such that the feed ram, workpiece engaging surface, or those portions thereof generally form a seal with the feed chute 608. However, in alternative embodiments, a seal need not be formed, and the feed ram 610 may be configured to fit the feed chute 608 loosely, snuggly, or anywhere therebetween.

In some embodiments, the cutter housing 404 may have a feed chute access opening 402. Like access opening 302, the access opening 402 may provide access to the feed chute 608 from the exterior of the cutter housing 404, such that a workpiece W may be placed within the feed chute. In one embodiment, the access opening 402 may provide access to the feed chute 608 without removing the feed ram 610 entirely from the feed chute. In further embodiments, the access opening 402 may not be accessible while the feed ram 610 is in a working position already holding a workpiece W against the rotary cutter 606, or in an otherwise full insertion state. In some embodiments, the feed ram 610 itself may block access from the access opening 402 when in a working position or an otherwise full insertion state. However, the cutter housing 404, feed chute 608, and/or feed ram 610 may be designed for any desired configuration of when access to the feed chute through the access opening 402 is permitted.

In some embodiments, cutter housing 404 may have a discharge chute (not shown). The discharge chute comprises of a hollow passageway where the fibers may exit out through the bottom of cutter housing 404.

Like feed ram 210, in some embodiments, based on the materials used to manufacture the feed ram 610, the feed ram may already have a desired amount of weight while, in other embodiments, the feed ram may be specifically designed to have a desired weight or may include additional weight to give the feed ram a desired weight. Due to the force of gravity, the weight of the feed ram 610 may be one factor assisting in maintaining the workpiece W against the rotary cutter 606, and in some embodiments, assist in preventing the workpiece from rotating while it is in contact with the rotary cutter.

In addition, or alternatively, milling device 400 may include a crank or other tightening or ratcheting device 410 for applying a desired force to the feed ram 610 in the direction of the rotary cutter 606, and thus a desired force on the workpiece W against the rotary cutter. In one embodiment, the tightening device 410 may be a manual crank, and may be set to the desired amount of force by manual operation, such as by but not limited to, using a hand crank 412. In other embodiments, the tightening device 410 may include an electric or computer controlled drive, and may for example, be set to the desired amount of force using an electrical signal or computer control system. It is recognized that any other suitable mechanism may be used as the tightening device, such as but not limited to a screw drive or pneumatic or hydraulic ram.

The feed ram 610, and any tightening device 410, may be made from any suitable material, such as but not limited to metal, metal alloy, plastic, wood, or any other suitable material or combinations thereof, and in some embodiments, may be made of a material or combination of materials that are cleanable and/or autoclavable. Thus, feed ram 610, and/or tightening device 410, may be decoupled from the cutter housing 404 and feed chute 608, such that it may be separately cleaned and/or autoclaved.

As discussed above, the cutter housing 404 may coupled to a support bearing and may be selectively rotatable between several angular orientations using a plurality of selectable orientation slots, a locking slot, and a retention device in conjunction to give the cutter housing 404 a rotatable nature. Accordingly, like cutter housing 204, the cutter housing 404 may be selectively angularly oriented between a substantially horizontal or zero degree (0°) position, whereby the feed chute 608 is substantially at a horizontal or zero degree (0°) orientation with respect to the rotary cutter 606, and a vertical or ninety degree (90°) position, whereby the feed chute is substantially at a vertical or ninety degree (90°) orientation with respect to the rotary cutter. However, it is understood that the range of angular rotation of the cutter housing 404 may include any other suitable range greater than or less than a ninety degree (90°) range and is not limited to a ninety degree (90°) range.

As discussed above, rotation of the cutter housing 404 can thus permit varying amounts of force to be applied to the workpiece W by the feed ram 610 simply due to the forces of gravity acting on the feed ram at each angular position. For example, at a substantially horizontal or zero degree (0°) orientation, the forces of gravity acting on the feed ram 610 may be such that the feed ram applies substantially no force against the workpiece W. Similarly, at a substantially vertical or ninety degree (90°) orientation, the forces of gravity acting on the feed ram 610 may be such that the feed ram applies substantially the full force of its weight against the workpiece W. As will be understood, any amount of force between substantially no force and substantially full force may be provided for between a horizontal or zero degree (0°) orientation and a vertical or ninety degree (90°) orientation. However, in alternative embodiments, the force applied to the workpiece W by feed ram 610 may be supplied entirely by the tightening device 410, discussed above.

Figure 8:
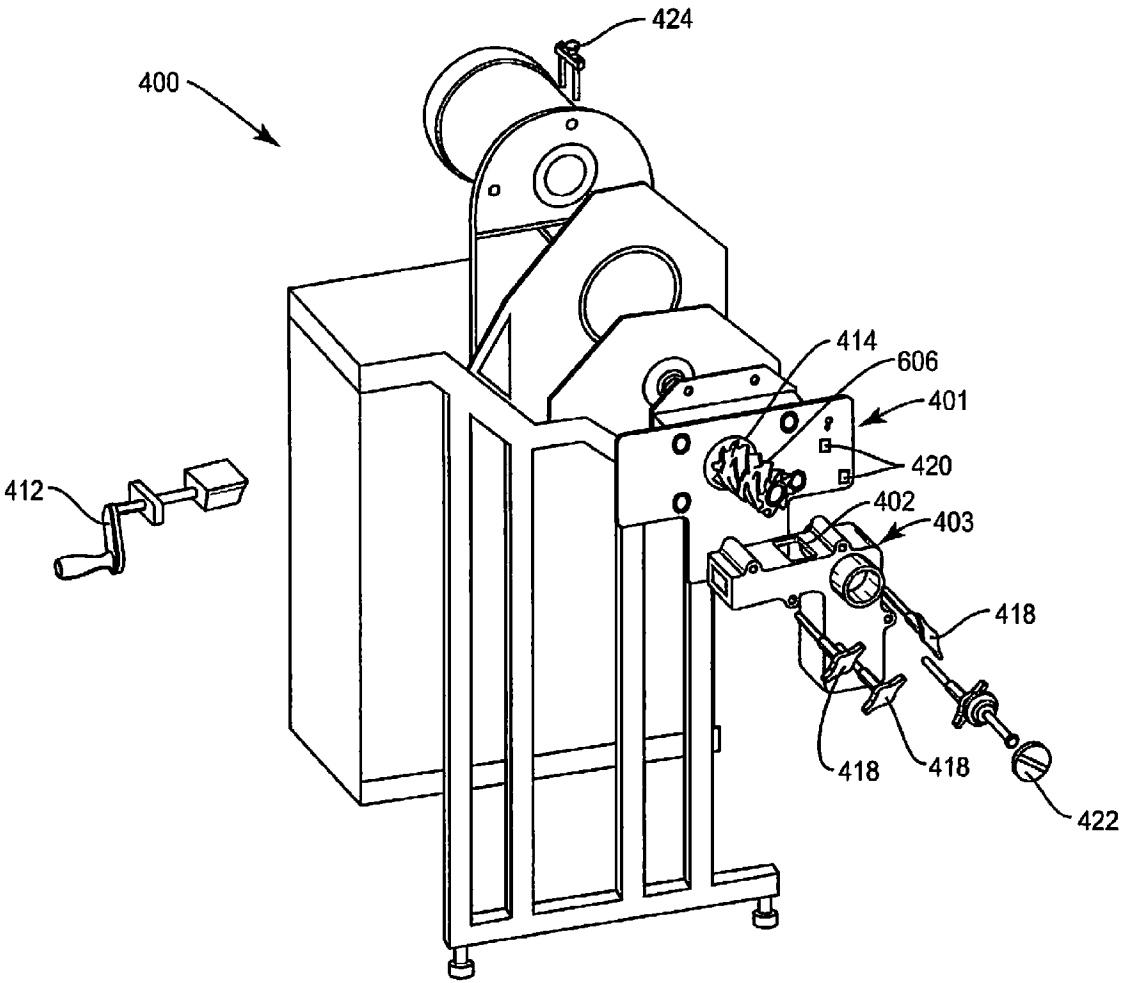
FIG. 8 is a perspective view of an oseteobiologic milling machine in accordance with an embodiment of the present disclosure.
Figure 9:
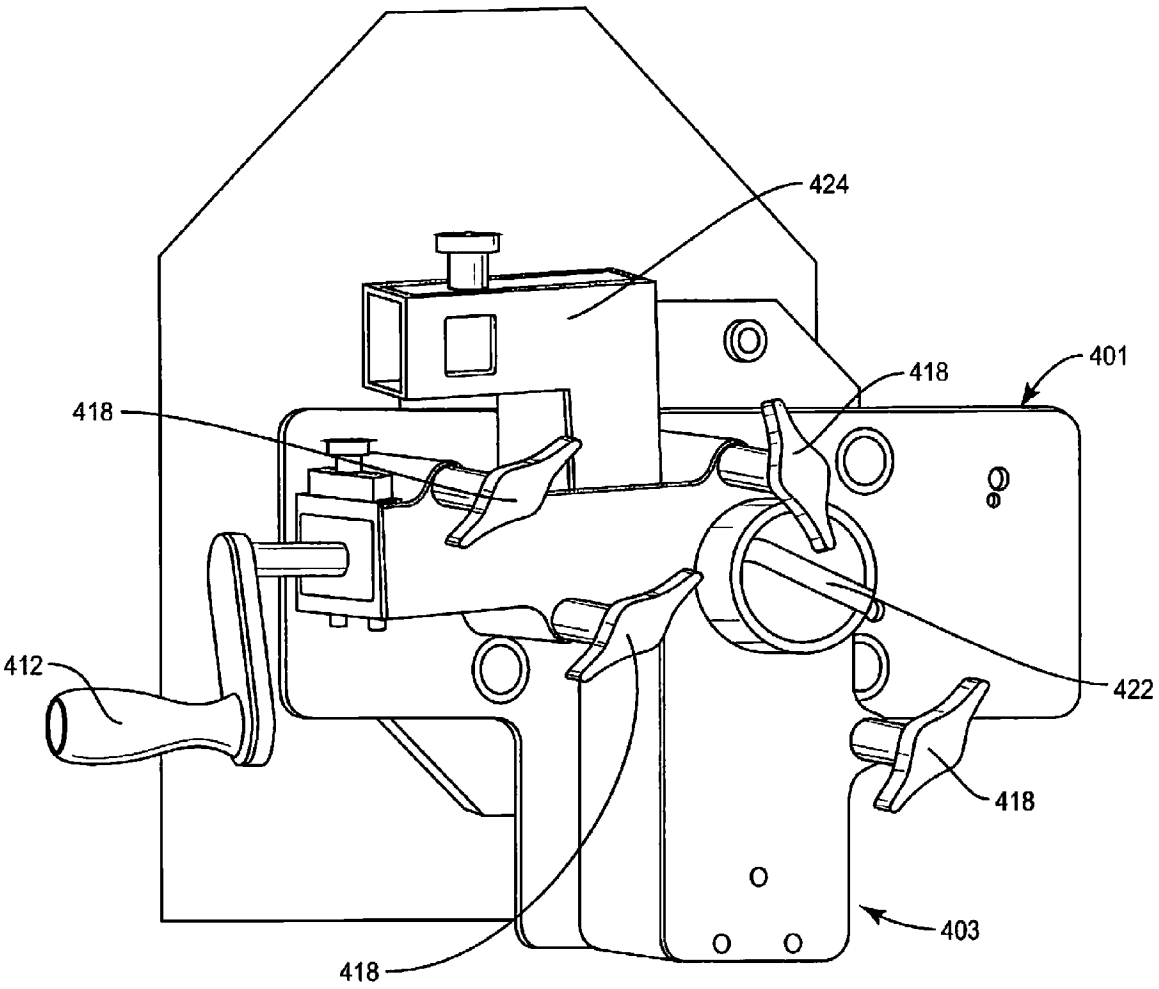
FIG. 9 is a perspective view of an oseteobiologic milling machine in accordance with an embodiment of the present disclosure.

In addition, or alternatively, milling device 400 may include certain safety features as shown in FIGS. 7-9. For example, milling device 400 may include a safety interlock positioned between backing plate 401 and front cover 403. Sensors 420, are attached to backing plate 401 and detect the proximity of front cover 403 in relation to backing plate 401. Milling device 400 will not run unless sensors 420 detect front cover 403. The distance between sensors 420 and front cover 403 may be adjustable.

In some embodiments, feed chute 608 may be elevated above engaging end or surface 630 to prevent those operating the device from getting too close to rotary cutter 606. In some embodiments, milling device 400 may include safety bars (not shown) located at the bottom of milling device 400. The safety bars will prevent operators from gaining access to rotary cutter 606 from the bottom of milling device 400.

As will be appreciated, in one embodiment, each of the bone contacting components, such as but not limited to, the cutter housing 404, rotary cuter 606, feed ram 610, and/or fiber collection unit, may each be separated from one another, if desired, and cleaned. In a further embodiment, each of the bone contacting components may be, together or separately, cleaned through autoclaving.

Figure 10:
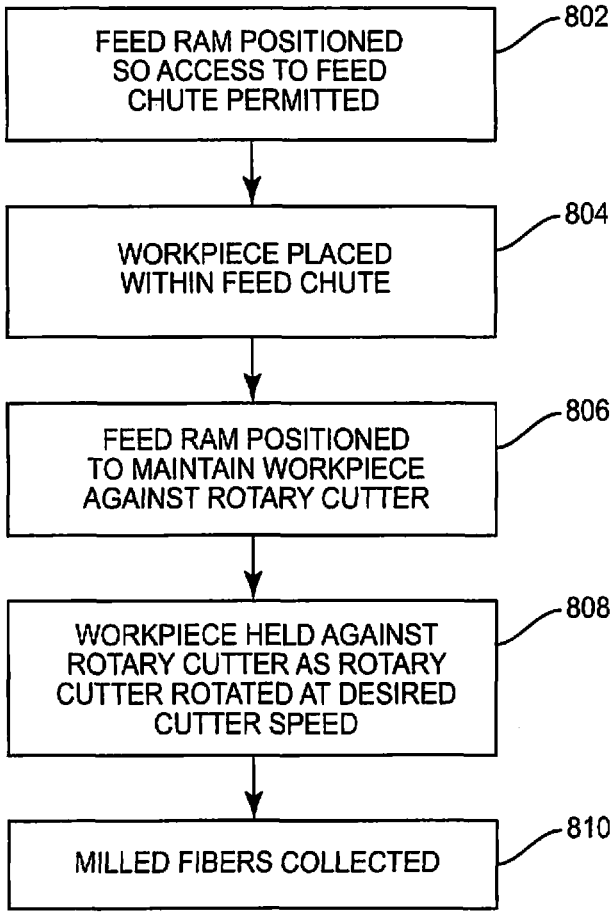
FIG. 10 is a flow chart illustrating a method of using an osteobiologic milling machine according to one embodiment of the present disclosure.

Having described various embodiments of an osteobiologic milling machine of the present disclosure, a method of using the osteobiologic milling machines, according to one embodiment of use, will now be described with reference to FIG. 10. As shown in FIG. 10, in step 802, the feed ram may be positioned such that access to the feed chute from the access opening is available. In step 804, a workpiece W may be placed within the feed chute from the access opening. As discussed above, a workpiece may be any suitable size and shape that fits within the feed chute. In one embodiment, the workpiece W may be bone, including but not limited to, human donor bone. However, the milling devices of the present disclosure may be used for milling any suitable materials. In step 806, the feed ram may be repositioned to assist in maintaining the workpiece W against the rotary cutter, and in some embodiments, assisting in preventing the workpiece from rotating while it is in contact with the rotary cutter. The force applied to the workpiece W by the feed ram may be provided in any of the manners previously discussed, such as but not limited to, using the forces of gravity on the feed ram, with or without the assistance of selectable angular positioning, using a tightening device, such as a manual crank or drive system, using a screw drive, or using a pneumatic or hydraulic ram. In step 808, the workpiece W may be held against the rotary cutter as the rotary cutter is rotated at a desired cutter speed, such that fibers are milled from the workpiece. In step 810, the fibers may be collected and/or removed from the milling device and used as is or for later processing.

As will be understood from the foregoing, one advantage of the osteobiologic milling machines of the present disclosure is that up to about one hundred percent (100%) of the workpiece may be successfully milled. Another advantage of the osteobiologic milling machines of the present disclosure is that, in some embodiments, each of the bone contacting components may be separated from one another, if desired, and cleaned. In still further embodiments, each of the bone contacting components may be, together or separately, cleaned through autoclaving. Yet another advantage of the osteobiologic milling machines of the present disclosure is that the milling can be a continuous process without, for example, the need for multiple directional changes and indexing of a cutter, as with traditional milling devices, and without the need for stopping in order to insert a new workpiece.

Although the various embodiments of the present disclosure have been described with reference to preferred embodiments, persons skilled in the art will recognize that changes may be made in form and detail without departing from the spirit and scope of the present disclosure.

What is claimed is:

1. A milling apparatus comprising:

a cutter housing having a feed chute;

a rotary cutter, at least partially housed within the cutter housing and in communication with the feed chute; and a feed ram removably positioned within the feed chute for maintaining a workpiece against the rotary cutter;

wherein the feed chute and feed ram are selectively positionable at one of a plurality of angular positions with respect to the rotary cutter, such that the force applied by the feed ram on the workpiece is a function of the weight of the feed ram and the angular position of the feed ram with respect to the rotary cutter.

2. The milling apparatus of claim 1, wherein the housing comprises a plurality of selectable orientation slots, each of the selectable orientation slots corresponding to an angular position of the feed chute and feed ram to the rotary cutter.

3. The milling apparatus of claim 1, wherein the rotary cutter comprises a plurality of helical bladed edges.

4. The milling apparatus of claim 3, wherein the rotary cutter cuts fibers from the workpiece parallel to a longitudinal axis of the workpiece.

5. The milling apparatus of claim 4, wherein the rotary cutter comprises breaks in the helical bladed edges.

6. The milling apparatus of claim 1, further comprising a manual crank coupled with the rotary cutter, such that the rotary cutter can be manually operated.

7. The milling apparatus of claim 1, further comprising a drive motor coupled with the rotary cutter, such that the rotary cutter can be electrically controlled.

8. The milling apparatus of claim 1, wherein the cutter housing further comprises a feed chute access opening.

9. The milling apparatus of claim 1, wherein the cutter housing further comprises a discharge chute.

10. The milling apparatus of claim 1, wherein the cutter housing further comprises a safety interlock.

11. The milling apparatus of claim 1, wherein the feed ram comprises a workpiece engaging surface that is configured for preventing the workpiece from rotating about its longitudinal axis.

12. A milling apparatus comprising:

a cutter housing having a feed chute;

a rotary cutter, at least partially housed within the cutter housing and in communication with the feed chute;

a feed ram removably positioned within the feed chute for maintaining a workpiece against the rotary cutter; and a tightening device coupled with the feed ram and selectively and controllably providing a force to the feed ram in the direction of the rotary cutter, wherein the feed chute and feed ram are selectively positionable at one of a plurality of angular positions with respect to the rotary cutter.

13. The milling apparatus of claim 12, wherein the tightening device is a manual crank.

14. The milling apparatus of claim 12, wherein the rotary cutter comprises a plurality of helical bladed edges.

15. The milling apparatus of claim 12, further comprising a manual crank coupled with the rotary cutter, such that the rotary cutter can be manually operated.

16. The milling apparatus of claim 12, further comprising a drive motor coupled with the rotary cutter, such that the rotary cutter can be electrically controlled.

17. The milling apparatus of claim 12, wherein the cutter housing further comprises a feed chute access opening.

18. The milling apparatus of claim 12, wherein the cutter housing further comprises a discharge chute.

19. The milling apparatus of claim 12, wherein the cutter housing further comprises a safety interlock.

* * * * *